US006776499B2

(12) United States Patent
Chang

(10) Patent No.: US 6,776,499 B2
(45) Date of Patent: Aug. 17, 2004

(54) SCREW OPENER WITH AN ILLUMINATION DEVICE

(76) Inventor: Tsung-Chieh Chang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/244,832

(22) Filed: Sep. 17, 2002

(65) Prior Publication Data

US 2004/0052069 A1 Mar. 18, 2004

(51) Int. Cl.[7] ..... B25B 23/18

(52) U.S. Cl. ..... 362/119; 362/120; 362/800; 403/301

(58) Field of Search ..... 362/109, 119, 362/120, 800, 399; 81/60, 91.2, 91.3, 92; 403/321, 301; 464/119

(56) References Cited

U.S. PATENT DOCUMENTS 5,772,308 A * 6/1998 Lin ..... 362/119
5,845,986 A * 12/1998 Breen ..... 362/119
6,095,659 A * 8/2000 Hsu ..... 362/119
6,168,287 B1 * 1/2001 Liu ..... 362/119

* cited by examiner

*Primary Examiner*—Alan Cariaso
*Assistant Examiner*—Ali Alavi

(57) ABSTRACT

A handle has a rod body and a handle. The rod body and the handle are installed with an illuminating device and driving structures. The rod body is formed by a first driving rod and a second driving rod. One end of the rod body is formed with a driving structure which is formed by a teethed half ball. One end of the second driving rod is installed with an opener head and another end of the second driving rod is formed with another driving structure which is a teethed half ball. The driving structure of the first driving rod and the driving structure of the second driving rod are engaged and then they are sleeved by the sleeve; thereby, the rod body can be bent with a predetermined angle and has a function of illumination.

6 Claims, 6 Drawing Sheets

SCREW OPENER WITH AN ILLUMINATION DEVICE

BACKGROUND OF THE INVENTION

1. Field of the Invention

The present invention relates to screw openers, and particularly to a screw opener with an illumination device.

2. Description of Related Art

Referring to FIG. 1, a prior art screw opener is illustrated. The screw opener is formed by a combining element, a connecting element and a sleeve. The connecting is installed with a spring and a positioning bead. A shaft is installed between the combining element and the combining element so that the rod of the screw opener may be bent through an angle. However, the structure of the prior art is complex. Not only the cost in manufacturing is high, but also the rod only bends through 90 degrees. This is not practical. Moreover, when the prior art screw opener is rotated through 90 degrees, the handle and the screw head is connected by a third component. The rotating effect is bad and the quality is not uniform. Moreover, the sleeve easy displace when the screw opener screws an object straightly so as to affect the operation of screwing.

Moreover, in a dark environment, when the user screws an object by the screw opener, the user must take a flashlight. However, the operation is inconvenient. It is often that two people are necessary in operation.

SUMMARY OF THE INVENTION

Accordingly, the primary object of the present invention is to provide a handle having a rod body and a handle. The rod body and the handle are installed with an illuminating device and driving structures. The rod body is formed by a first driving rod and a second driving rod. One end of the rod body is formed with a driving structure which is formed by a teethed half ball. One end of the second driving rod is installed with an opener head and another end of the second driving rod is formed with another driving structure which is a teethed half ball. The driving structure of the first driving rod and the driving structure of the second driving rod are engaged and then they are sleeved by the sleeve; thereby, the rod body can be bent with a predetermined angle and has a function of illumination.

The various objects and advantages of the present invention will be more readily understood from the following detailed description when read in conjunction with the appended drawing.

DETAILED DESCRIPTION OF THE PREFERRED EMBODIMENTS

Figure 1:
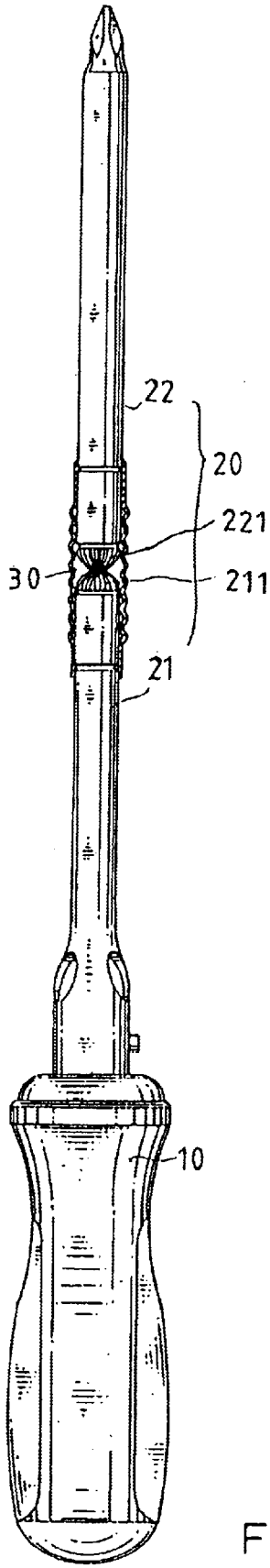
FIG. 1 is a schematic cross sectional view of the present invention.
Figure 2:
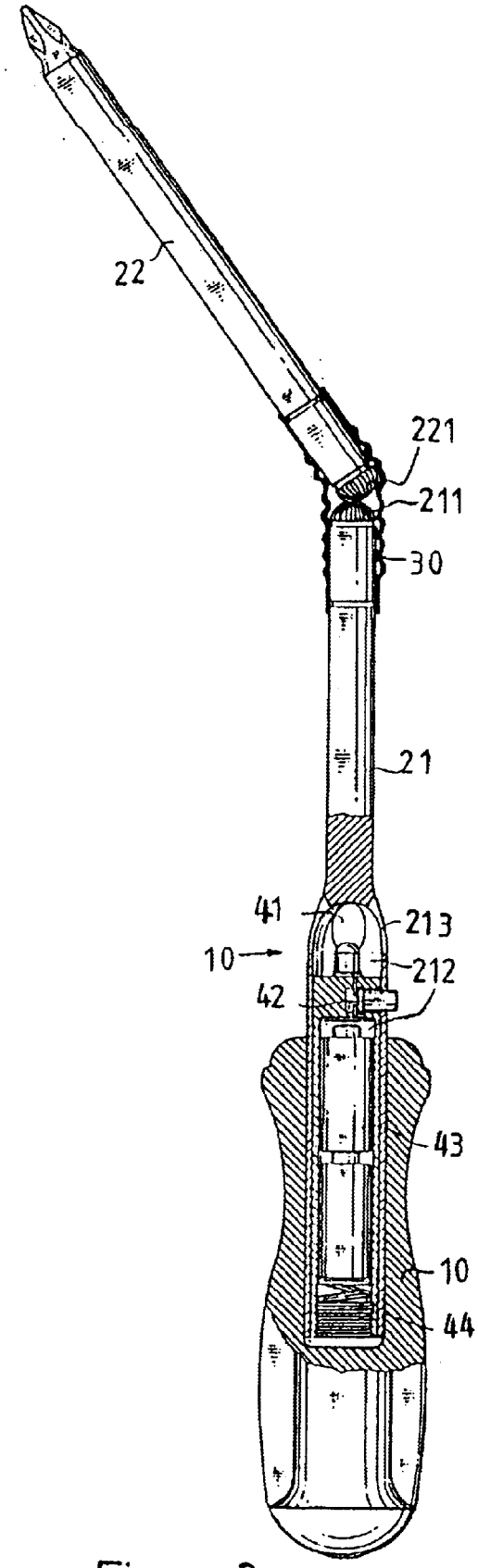
FIG. 2 shows the first embodiment of the present invention.

Referring to FIGS. 1 and 2, the screw opener of the present invention includes a handle 10, a rod body 20, a sleeve 30 and an illuminating device 40.

The handle 10 is a means for being held by a user. The inner side of the handle 10 has a hole 11 at the inner side thereof for being connected to one end of the rod body 20.

The rod body 20 is formed by a first driving rod 21 and a second driving rod 22. One end of the first driving rod 21 is inserted into the hole 11 of the handle 10. Another end of first driving rod 21 is formed with a driving structure 211 which is formed by a teethed half ball.

An inner side of the first driving rod 21 adjacent to the handle 10 is expanded as a receiving space 212 for receiving the illuminating device 40. A front end of the receiving space 212 is formed with a plurality of via holes 213 so that light can be emitted from the via holes 213.

One end of the second driving rod 22 may be installed with an opener head and another end of the second driving rod 22 is formed with another driving structure 221 which is a teethed half ball. The driving structure 211 of the first driving rod 21 and the driving structure 221 of the second driving rod 22 are engaged and then they are sleeved by the sleeve 30. The sleeve 30 is plastic and rigid. The periphery of the sleeve 30 is formed with waveform structure so that the first driving rod 21 and second driving rod 22 are combined firmly. Thereby, the rod body 20 can be bent with a predetermined angle.

The illuminating device 40 is formed by a bulb body 41, a control key 42, a battery 43, conductor 44, etc. The bulb body 41 is installed in a front end of the receiving space 212. The battery 43 and the conductor 44 are installed in the inner edge of the receiving space 212. The control key 42 is installed between the bulb body 41 and the battery 43. By adjusting the control key 42, the bulb body 41 light up so that the screw opener has a function of illumination.

Thereby, by above said structure, after the driving structures 211 and 221 at one ends of the first driving rod 21 and one end of the second driving rod 22 are engaged and secured, the rod body 20 can be bent with a predetermined angle. Meanwhile, by the installation of the illuminating device 40, the use of screw opener is practical.

Figure 3:
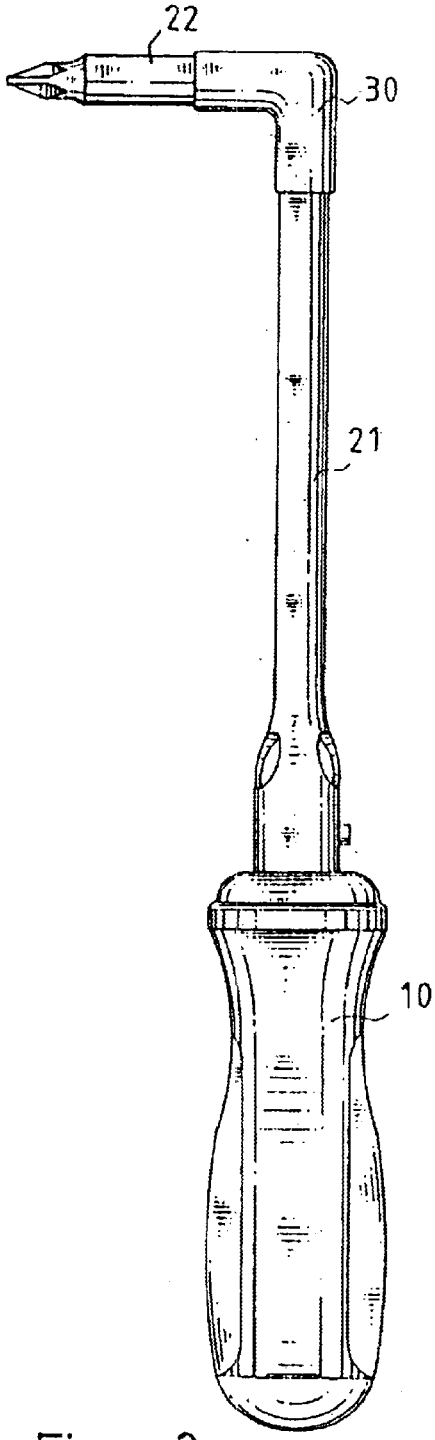
FIG. 3 is a schematic perspective view showing the appearance of the second embodiment of the present invention.
Figure 4:
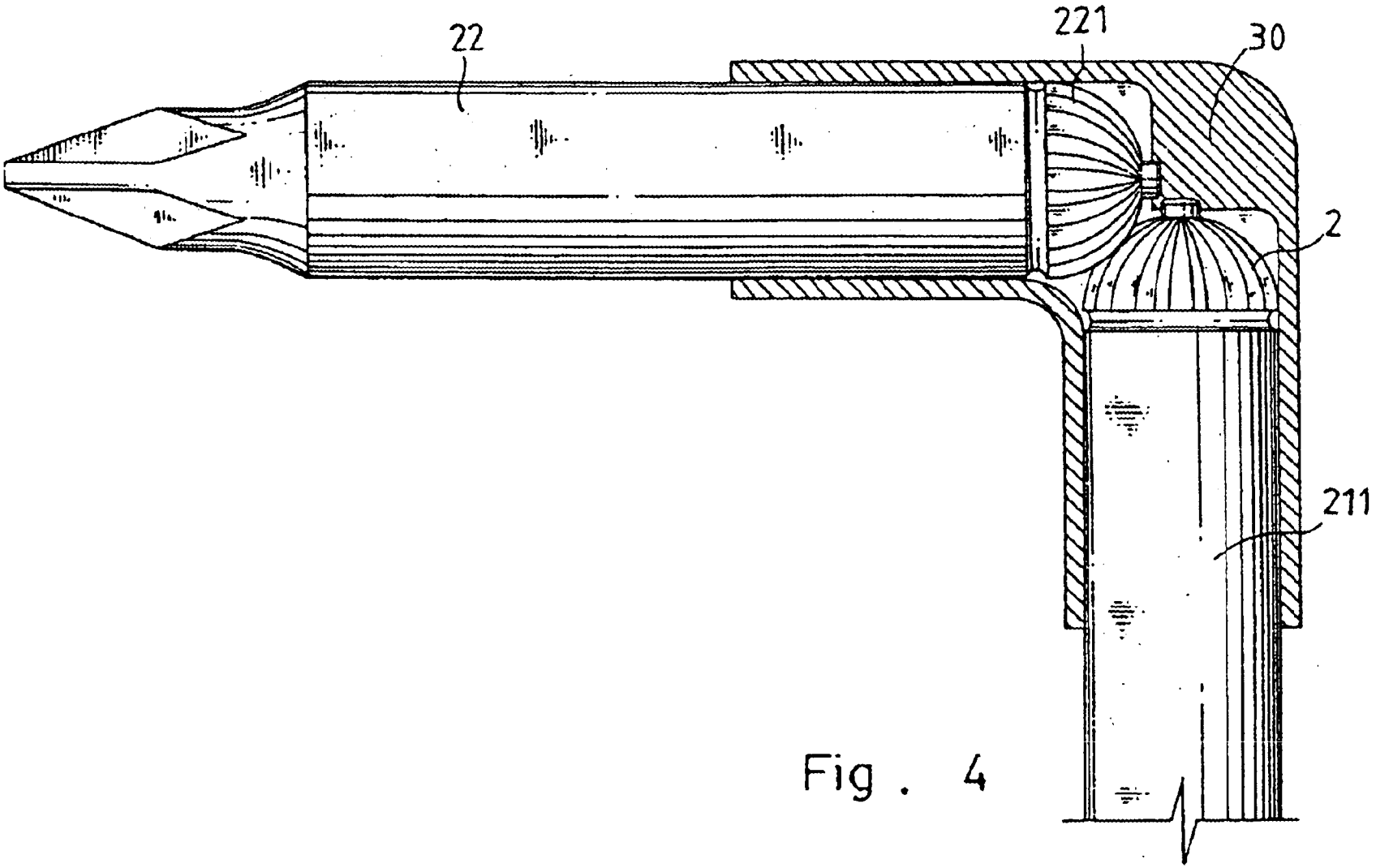
FIG. 4 is a partial cross sectional view of the second embodiment of the present invention.

Moreover, referring to FIGS. 3 and 4, in the present invention, the structure of the sleeve 30 may have a rigid L shape. The first driving rod 21 and second driving rod 22 can be engaged to be a rectangular shape. Thereby, the rod body 20 is used to screw a screw located in a dead space. Thus, the present invention is preferred than the prior art.

Figure 6:
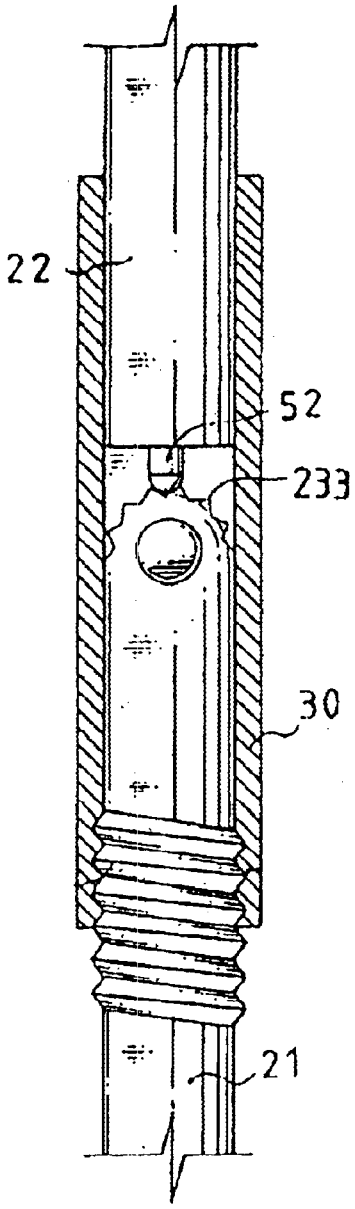
FIG. 6 is a cross sectional view of the third embodiment of the present invention.
Figure 5:
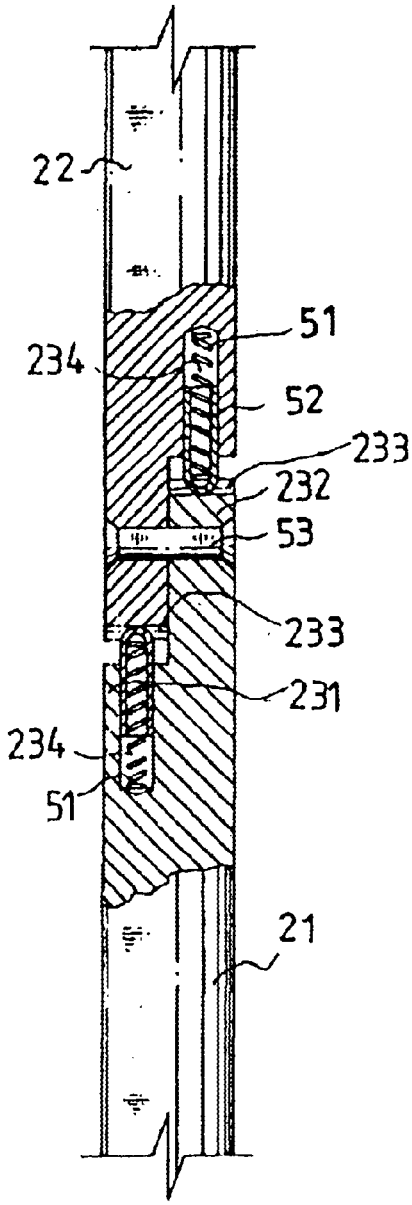
FIG. 5 is an assembled cross sectional view of the third embodiment of the present invention.
Figure 7:
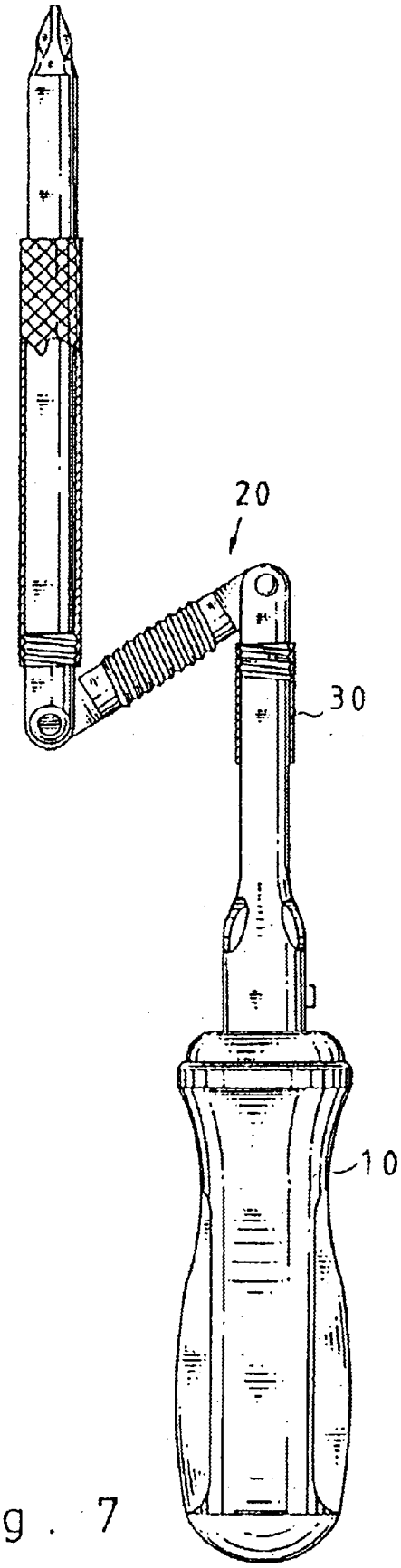
FIG. 7 is a schematic view of the third embodiment of the present invention.
Figure 8:
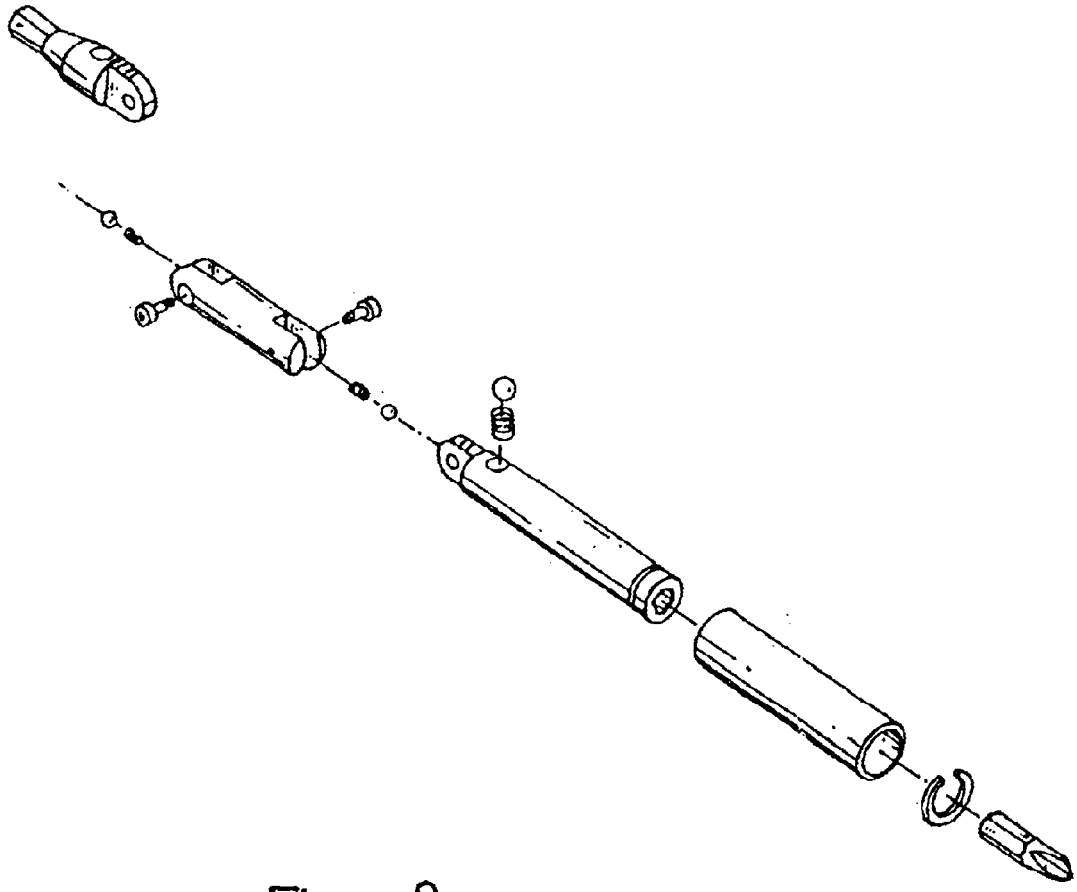
Fig. 8 PRIOR ART
FIG. 8 is an exploded schematic view of a prior art.

Moreover, referring to FIGS. 5 to 7, another embodiment of the present invention is illustrated. In this embodiment, each of the driving structures 211 and 221 of the first driving rod 21 and second driving rod 22 is formed with stepped structures with convex surface 231 and concave surface 232. The outer edge of the convex surface 231 is formed with teeth portion 233. Each receiving hole 234 can receive an elastomer 51 and two ejecting means 52.

After the convex surface 231 and concave surface 232 are connected by a pivotal shaft 53, the two ejecting means 52 are ejected by elastomers 51. In that the two ejecting means 52 are ejected by the two elastomers 51. Then the ejecting means 52 ejects a respective teeth portion 233 so that the rod body 20 can bend with a predetermined angle. As the rod body 20 is bent, the ejecting means 52 serve to position the rod body 20 in a desired angle.

As described above, when the rod body 20 is desired to drive a screw straightly, a straight-tube sleeve 30 is used to sleeve the first driving rod 21 and second driving rod 22. The feature of the sleeve 30 is that it can be secured by threaded connection so as to be positioned on the first driving rod 21 and second driving rod 22 (referring to FIG. 6). When the screw opener is used, the sleeve 30 will not separate from the rod body 20.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A handle having a rod body and a handle; the rod body and the handle being installed with an illuminating device and a first and a second driving structures; characterized in that:

the rod body is formed by a first driving rod and a second driving rod; one end of the first driving rod is connected to the handle; another end of the first driving rod is formed with the first driving structure which is formed by a teethed half ball; an inner side of the first driving rod adjacent to the handle is expanded as a receiving space for receiving the illuminating device; a front end of the receiving space is formed with a plurality of via holes so that light is emitted from the via holes;

one end of the second driving rod is installed with an opener head and another end of the second driving rod is formed with the second driving structure which is a teethed half ball; the driving structure of the first driving rod and the driving structure of the second driving rod are engaged and then they are sleeved by the sleeve; thereby, the rod body is bent with a predetermined angle and has a function of illumination.

2. The handle as claimed in claim 1, wherein illuminating device is formed by a bulb, a control key, a battery and a conductor which are sequentially installed in a receiving space.

3. The handle as claimed in claim 1, wherein a periphery of the sleeve is formed with waveform structure so that the first driving rod and second driving rod are combined firmly.

4. The handle as claimed in claim 1, wherein the structure of the sleeve has a rigid L shape; the first driving rod and second driving rod are engaged to be a rectangular shape; thereby, the rod body is used to screw a screw located in a dead space.

5. The handle as claimed in claim 1, wherein each of the driving structures of the first driving rod and second driving rod is formed with stepped structures with a convex surface and concave surface, respectively; an outer edge of the convex surface is formed with teeth portion; each receiving hole is received an elastomer and two ejecting means; after the convex surface and concave surface are connected by a pivotal shaft, the two ejecting means are ejected by elastomers; in that the two ejecting means are ejected by the two elastomers; then, the ejecting means ejects a respective teeth portion so that the rod body bends with a predetermined angle.

6. The handle as claimed in claim 1, further comprising a sleeve for enclosing the first driving rod and second driving rod, so that when the rod body is screwed in the sleeve, and thus the first driving rod and the second driving rod are connected secured.

* * * * *